US008001635B2

(12) United States Patent
Humbles

(10) Patent No.: US 8,001,635 B2
(45) Date of Patent: Aug. 23, 2011

(54) SURGICAL ARM POSITIONING PAD

(76) Inventor: Frank Forrest Humbles, Conway, SC (US)

( * ) Notice: Subject to any disclaimer, the term of this patent is extended or adjusted under 35 U.S.C. 154(b) by 0 days.

(21) Appl. No.: 12/931,545

(22) Filed: Feb. 4, 2011

(65) Prior Publication Data

US 2011/0167563 A1 Jul. 14, 2011

(51) Int. Cl.
*A61G 13/12* (2006.01)

(52) U.S. Cl. ..... 5/623; 5/646; 5/621; 5/632

(58) Field of Classification Search ..... 5/621–624, 5/646–647, 632

See application file for complete search history.

(56) References Cited

U.S. PATENT DOCUMENTS

2005/0091749 A1* 5/2005 Humbles ..... 5/646

* cited by examiner

*Primary Examiner* — Fredrick Conley
(74) *Attorney, Agent, or Firm* — Michael E. Mauney

(57) ABSTRACT

An arm protection apparatus for a patient's arms when the patient is in a prone or supine position. An injured party who is unable to voice complaints of pain or pressure may be positioned on an operating table or on a stretcher. The patient may be unconscious. There is a risk of injury to a patient's arm unless the patient's arm is secured in a safe positioned and cushioned from outside pressure. The arm protection apparatus involves a central pad, which is positioned under a patient's body. Sections come off the central pad, which may be positioned around a patient's arm. Ordinarily, a patient's upper arm and lower arm will both be contained within separate sections that are attached to the central portion of the pad. The pad will be constructed of a soft foam-like material, which is radiolucent and easily folded or cut as need be. The pad will ordinarily be disposable and discarded after one use and can be packaged and stored in a sterile container.

4 Claims, 4 Drawing Sheets

SURGICAL ARM POSITIONING PAD

FIELD OF THE INVENTION

This invention is in the field of a positioning device for positioning a patient's arm in proximity to a patient's body during medical procedures like surgery. The purpose of the apparatus is to prevent an injury to the arm due to outside pressure or forces.

BACKGROUND OF THE INVENTION

During a surgical procedure the patient is anesthetized and is unable to either voice complaints of pain or to move his or her extremities in response to pain stimulus. Consequently, the responsibility of positioning the patient so as to avoid injuries to the patient's body outside of the operative area is the responsibility of the operating room personnel. More particularly, procedures done on the central part of a patient's body, including the head and neck, require that operating room personnel be in close proximity to a patient's body for extended periods of time. During these periods of time a patient's arm is simply in the way. For example, during a laparoscopic procedure surgeons are positioned close to a patient's side and high enough on a patient's torso so that a patient's arm cannot be placed on an arm rest perpendicular to the body. This could stretch the arm too much and possibly cause a brachial nerve injury. In order to position a patient's arm in these types of procedures, a number of expedients can be employed. Ad hoc equipment is sometimes used, such as a cardboard box, which may be used to support a patient's hand. The patient's arm and hand can be tucked and held in place by folding the surgical drape or other covering which may be placed underneath the patient, which then holds the patient's arm in place along the patient's body.

A currently marketed product that is used to hold a patient's arm in place is sometimes called a sled or toboggan because of its resemblance to the item of the same name. One such item is marketed by a company called AliMed™ and is called a toboggan arm/leg guard. This is a hard plastic shell or sled. A portion of the sled slides under the operating room mattress, which is positioned on the operating room table. However, it can be difficult to position the portion of the sled that slides under the mattress because the operating table mattress is ordinarily attached in place onto the operating room table by a hook-and-eye attachment known by the trade name Velcro™. This Velcro™ forms a barrier to sliding the support portion of the sled under the mattress. The sled is made of hard material and the patient's arm, when positioned inside the sled, must be cushioned in some way. This protective device also makes it difficult to check IV and arterial line sites in the patient's hands or arms during a procedure. Moreover, because it is used from procedure to procedure, it can raise issues regarding the sterile field necessary during an operating room procedure. Unless made of appropriate materials, the sled may not be radiolucent, hence may make taking x-rays during the course of procedures more difficult.

A variation of the sled or toboggan is seen in Fischer, U.S. Pat. No. 5,785,057. This invention includes an elongated rigid shell with an end cap for enclosing one of the hands and fingers. A base portion is slid under the mattress to hold the sled in place. Tari, U.S. Pat. No. 4,662,366, discloses a radiolucent mobilizing arm support. This is designed primarily to secure a patient's arm during certain procedures, especially heart procedures, which require ongoing radiographic images, such as angioplasty. Consequently, the Tari patent uses a strap system which wraps completely around the operating room table, including the patient's torso, and a separate hand-securing strap portion which is secured to the patient's lower torso. The Tan device is inappropriate for use in most surgical procedures. However, the Tri patent does illustrate the desirability of a radiolucent securing device for a patient's arm. Longfellow, U.S. Pat. No. 2,237,252, discloses a rigid arm support for a patient's arm and includes two soft pads that support one for the upper arm and one for the lower arm. Straps are used to secure the patient's arm to the support. The support itself rests on a pivoting piece, which may rest either under the patient or under the operating table mattress. It is for use when the patient is in the supine position and the arm may need to be immobilized for extended periods.

Despite this earlier work, there is still a need for a simple, inexpensive, and easy to use device which will secure a patient's arms and protect them from injury from outside forces. It will be used during the course of procedures where the patient is in the prone or supine position. Sometimes a surgeon may be working in proximity to the patient's torso. This device can be made disposable, so that there will be no need to sterilize the device from use to use, thus to reduce the risk of contamination to the sterility of the operative field. This device should be easily and quickly removable from an extremity of a patient. When it is quickly and easily removable from an extremity of a patient, it facilitates the ability to reposition a patient during a procedure. The device should be flexible, so that a portion of it may be folded out of the way to visualize a patient's arm during a procedure. The device should be easily cut or torn by standard cutting devices, such as scissors, so that portions may be removed if necessary to provide continuous visualization of that portion of the patient's body which would otherwise be concealed under the device during use.

SUMMARY OF THE INVENTION

The current invention consists of a foam pad or other soft appropriate material. The pad is placed on the operating room table and is approximately the length of a patient's torso and has roughly a shape of a "H". Of course, the pad could be made of different sizes for different procedures, including pediatric cases. The width of the pad is sufficient to extend beyond and over the patient's supporting device, ordinarily, the operating room table's edge. An attachment means will be secured in the center of the pad on the side of the pad on which a patient is placed and will ordinarily be in use underneath a patient's body. Hook-and-eye materials sold by the commercial name of Velcro™ can be used for this purpose. The portions of the pad which extend over and beyond the operating room table are ordinarily split approximately midway along the length of the pad. Attached to the underside of the pad are strips of matching attachment means, such as hook-and-eye materials like Velcro™. The patient will then be positioned on top of the pad. Portions of the pad that extend over the edges of the mattress may be rolled up with the hook-and-eye material on the underside of the pad now being in position to be mated and attached to the hook-and-eye material which is positioned on the top of the pad, a portion of which would be under the patient's body. The patient's arm is secured within the now rolled up and attached portion of the pad. Where the pad is split, it forms a separate means for securing a patient's upper arm and a patient's lower arm in proximity to the patient's body. If necessary, a portion of the pad may be cut away or folded to expose a particular portion of the patient's hand or arm, which may be required for placement of arterial or IV lines during a procedure. In the event of an emergency or other circumstance which requires a repositioning of the patient, the pad may be quickly and easily removed from a patient's arm. The pad may be made so inexpensively that it can be discarded after a single use, thus reducing the risk of compromising the sterility of the operating field. The pad is radiolucent and does not interfere with the use of x-ray equipment during the course of surgery. Other advantages of this invention will become obvious in the Detailed Description of the Drawings, which follow.

DETAILED DESCRIPTION OF THE DRAWINGS

Figure 1A:
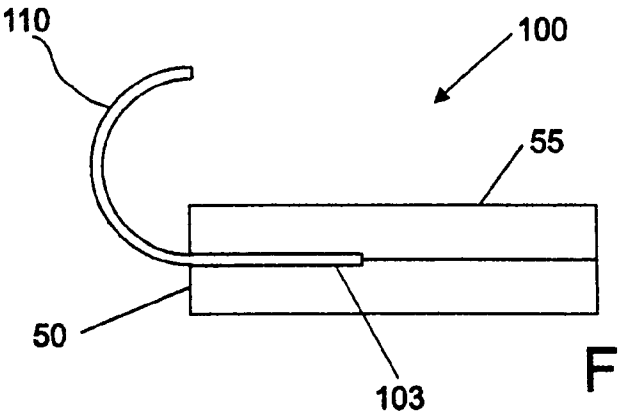
FIG. 1A Prior Art
FIGS. 1 and 1A show a prior art device.
Figure 1:
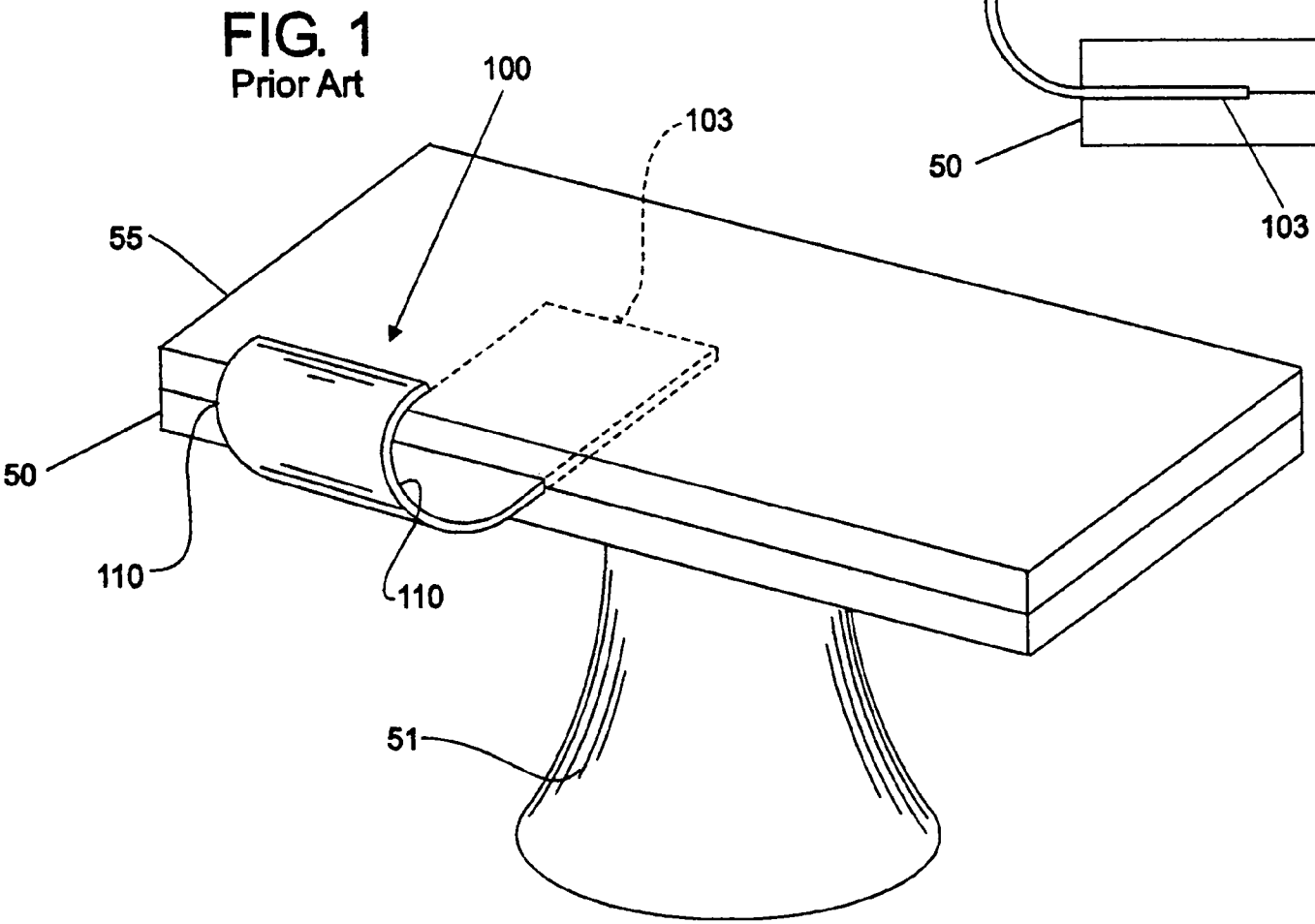
FIG. 1 Prior Art

FIG. 1 and FIG. 1A show an operating room table (50) on a pedestal (51) with an operating room table mattress (55) in place on top of the operating room table (50). A prior art toboggan (100) is shown positioned on the operating room table (50) with a support section (103) placed under the operating room table mattress (55) with a curved protective section (110) placed outside the operating room table mattress (55) and above the mattress (55) ready for positioning of a patient's arm. A patient will be positioned on the operating room table (50) in either the prone or supine position, with the appropriate portion of the patient's arm positioned within the curved protective section (110) of the toboggan (100). The patient's torso will rest on the operating room table mattress (55) with the weight of the patient pressing on the operating room table mattress (55) and on the support section (103) of the toboggan (100) and the operating room table (50) as shown in FIG. 1A. There are a number of drawbacks with the prior art toboggan device (100). First, the support section (103) usually slides between the operating room table mattress (55) and the operating room table (50). This creates several problems. One problem is that the operating room table mattress (55) is ordinarily secured to the operating room table (50) by some attachment means, such as the hook-and-eye means known by the trade name Velcro™. The support section (103) may have to slide between the hook part of the Velcro™ and the eye part of the Velcro™, either making the mattress (55) less secure on the operating room table (50) or making it difficult to get the support section (103) in place. Secondly, the curved protective section (110) of the toboggan (100) is rigid and hard, hence ordinarily some kind of padding must be provided for the patient's arm. Third, the toboggan (100), if made of metal, may be radio opaque and make it impossible to take x-rays without removing the toboggan (100) from the operating room table (50). Fourth, the toboggan (100) is rigid and completely covers at least a portion of a patient's arm thus, makes it difficult to visualize arterial or IV lines that are in place in a patient's arm during the procedure. This makes it difficult to check if the lines are functioning properly, if there has been an infiltration, or some other problem. While the toboggan (100) may be removed, to do so requires considerable effort since it is secured in place on the operating room table (50) by the weight of the patient which is resting on the support section (103). If the toboggan (100) is removed to check the arm of a patient or to take an x-ray, then repositioning can also require considerable effort because the toboggan (100) has to slide underneath the operating room table mattress (55) even though the patient's weight is resisting such a maneuver. Fifth, the toboggan (100) is ordinarily reused from one procedure to another. While it may be positioned outside of the surgical field, it is possible that body fluids, blood, or other contaminating materials may splash on it or may splash on any surgical drapes or materials that are covering it. If the toboggan (100) is reused, this represents a risk of contamination unless it is sterilized after each use. Even if sterilized after each use, if it is stored in a non-sterile environment for a period of time between uses, there is a risk of contamination from every day contaminants that are in the air.

Figure 2:
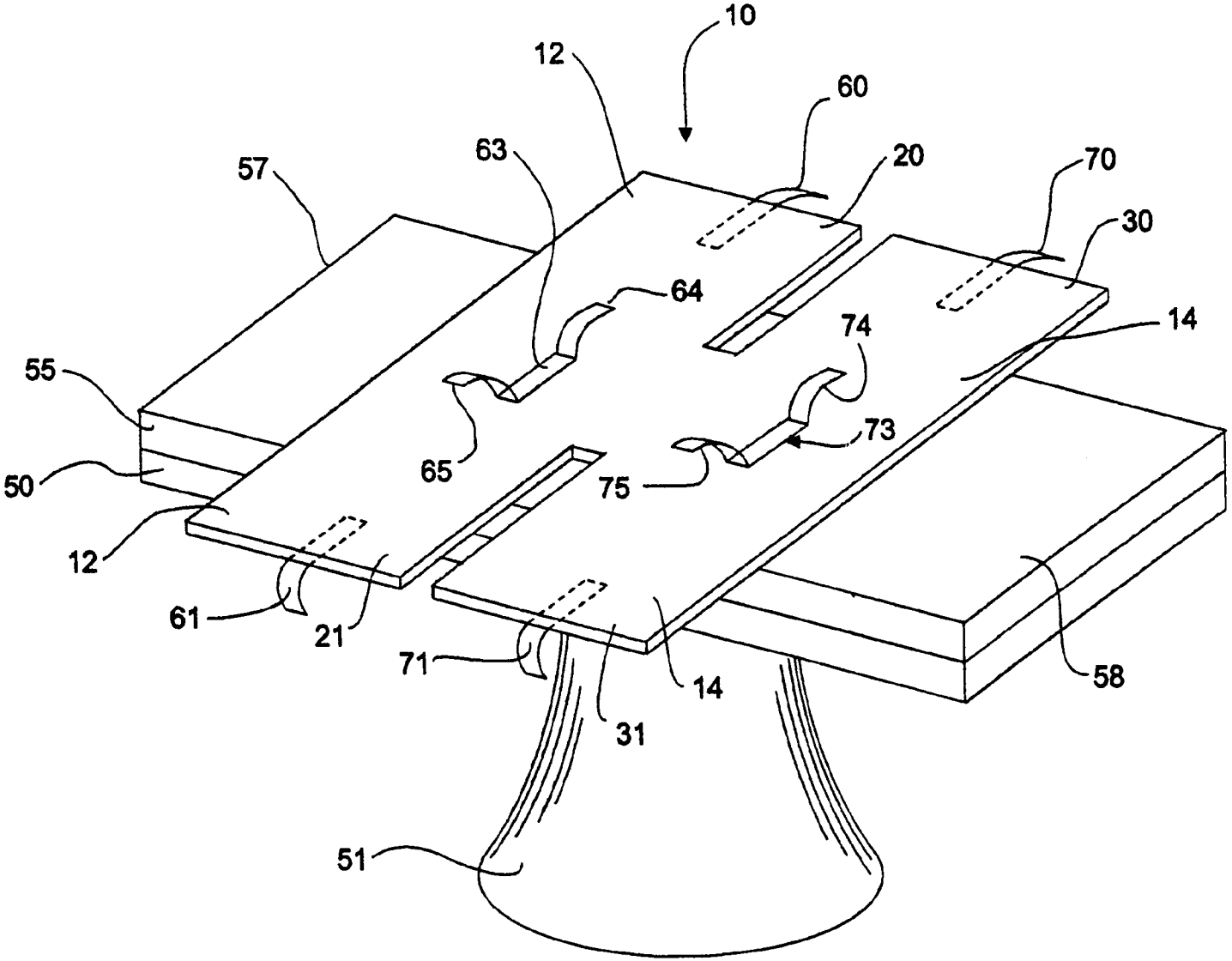
FIG. 2 shows the arm protector pad in place on an operating table.

FIG. 2 shows the arm protector pad invention (10) in place on top of an operating room table (50) and an operating room table mattress (55). The arm protector pad (10) is not drawn in proportion or scale in FIG. 2, but rather is somewhat exaggerated for better visualization. The arm protector pad (10) is in a roughly "H" shape. One vertical section of the "H" is the upper arm protector pad (12) while the other vertical arm of the "H" shape is a lower arm protector pad (14). Here, in order to better visualize the functioning of the arm protector pad (10), the head (57) of the operating room table (50) is seen from the viewer's left, while the foot (58) of the operating room table (50) is seen to the viewer's right. The operating room table (50) is supported by a pedestal (51). A patient will be positioned with his head toward the head (57) of the operating room table (50) and his feet toward the foot (58) of the operating room table (50). If a patient is positioned in the supine position on the operating room table (50) as described, then the patient's left side will be positioned toward the upper part of FIG. 2 and the patient's right side will be positioned toward the lower part of FIG. 2. With this configuration in mind, the arm protector pad (10) has an left arm upper protector section (20), an right arm upper protector section (21), a left arm lower protector section (30), and a right arm lower protector section (31). On the left arm upper protector section (20) is an attachment tape (60). The right arm upper protector section (21) has an attachment tape (61). Seen positioned in the middle of the upper arm protector pad (12) is a central upper attachment tape (63), which has a left portion (64) and a right portion (65). Likewise, the left arm lower protection section (30) has an attachment tape (70) and the right arm lower protector section (31) has an attachment tape (71). Likewise, there is a central lower attachment tape (73) with a left portion (74) and a right portion (75). As will be shown in more detail in other drawings, a patient will be positioned on the operating room table (50) with an upper edge of the arm protector pad (10) approximately aligned with and slightly below the armpit of the patient. A patient's upper arm or the portion of the arm extending from his shoulder to the elbow comprising the humerus bone and the various muscles and other tissues outside of the humerus bone will be positioned respectively on the left and right upper portions of the arm protector pad (10) so that the left arm upper protector section (20) and right arm upper protector section (21) may fold over and approximately enclose that portion of the patient's arm from the patient's shoulder to the patient's elbow. The connector tape (60) and (61) will be respectively attached to the central upper left and central upper right protector connector tapes (64) and (65). Shown here for clarity, there is a gap between the upper arm protector pad (12) and lower arm protector pad (14) which, as shown, could leave a portion of a patient's arm uncovered by the arm protector pad (10). The upper and lower sections, both right (21, 31) and left (20, 30), may not necessarily expose any portion of a patient's arm but will split into two sections at the elbow joint. These two sections (upper and lower) split to facilitate mounting of the sections but also will provide support and protection for the elbow joint and the portions of a patient's arm around the elbow joint. The portion of the patient's arm extending from the elbow to the wrist, which basically is the portion of the patient's arm supported by the bony structures of the radius and the humerus, will be enclosed within the left arm lower protector section (30) and right arm lower protector section (31) respectively. The attachment tapes (70) and (71) will be attached to the central lower attachment tape (73) on its left and right portions (74) and (75). The arm protector pad (10) will ordinarily be made of a soft, yielding, foam-like material. This provides a cushioning effect for the patient's arms while securing them in place in a position which will not threaten a stretching injury to any nerves within the arm. The arm protector pad (10) will shield the patient's arm from pressure that may come from a physician or other operating room personnel positioned around the operating room table (50) to the respective portions of the patient's arm covered by the arm protector pad (10). The attachment tapes (60, 70, 61, 71) may be easily and quickly detached from the matching central upper and lower attachment tapes (63) and (73) as necessary to completely visualize a portion of the patient's arm. The foam material that forms the arm protector pad (10) is soft and easily pulled aside to visualize a portion of the patient's arm. If necessary, the foam material can be cut away with standard cutting tools available in an operating room such as scissors. Moreover, the arm protector pad (10) could be constructed with pre-perforated tear-a-way sections as is necessary or appropriate to facilitate removal of a portion of the arm protector pad (10) as may be necessary to gain access to a vein or artery of a patient. The foam material forming the arm protector pad (10) is radiolucent and need not be removed or otherwise repositioned for x-rays. If it is necessary to reposition the patient, it is only necessary to remove a particular protector section (20, 21, 30, 31) as may be required to move the patient. If it is necessary to move the patient from a supine to a prone position or to quickly gain access to a portion of the patient that may otherwise be covered by the arm protector pad (10), it is easily accomplished using the Velcro™-like attachment materials which would ordinarily compose the various attachment tapes (60, 70, 61, 71, 63, 73). The arm protector pad (10) can be manufactured inexpensively enough to where it can be shipped in a sealed, sterile package hence, no special requirements or precautions are required to keep it sterile until ready for use. Like many other disposable items currently used in operating rooms, the package may be torn into and the arm protector pad (10) removed with confidence that it is sterile and ready for use in a single procedure. It may be used during the procedure and at the end of the procedure discarded along with other disposable materials, creating no risk of contamination because of reuse.

Figure 3:
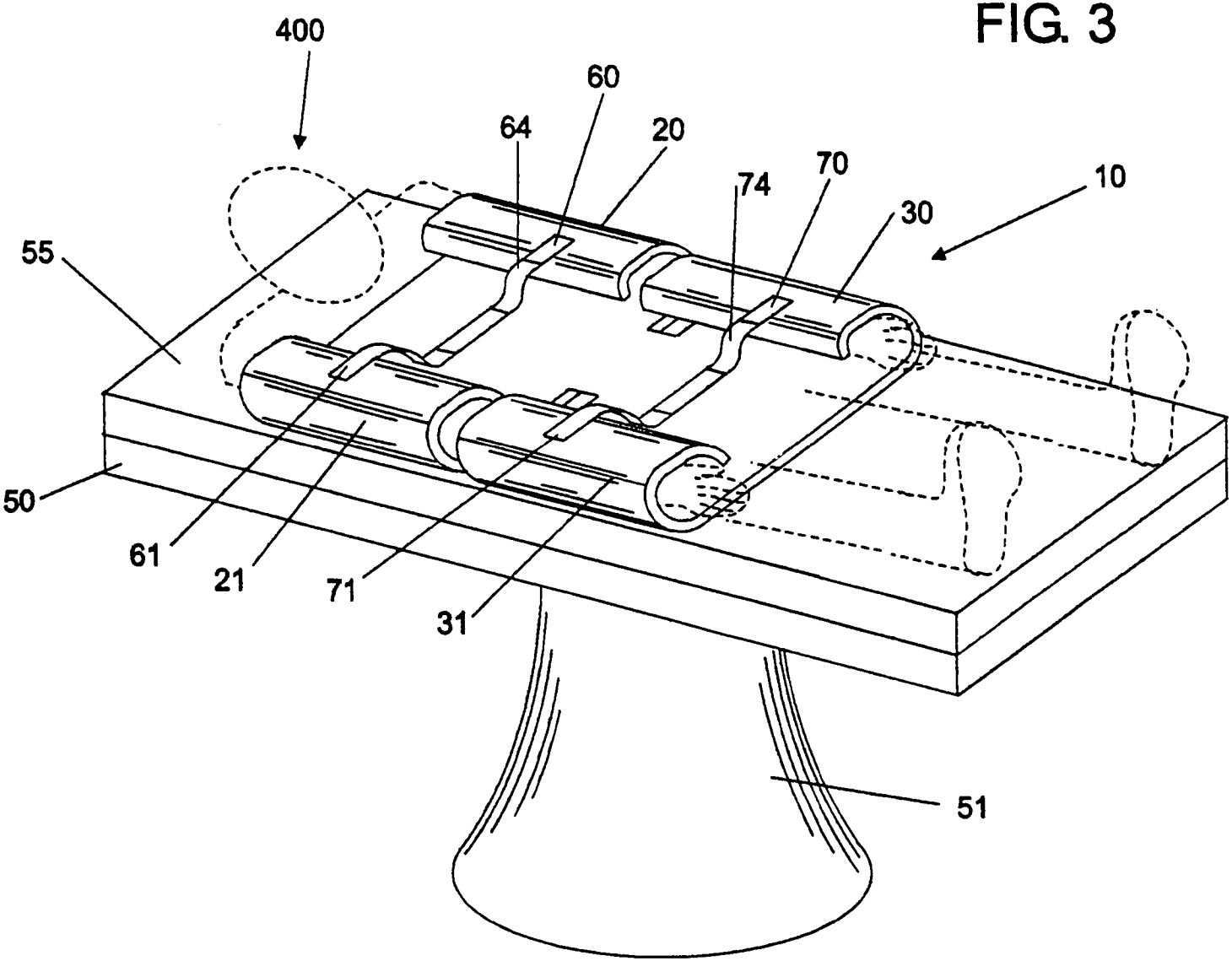
FIG. 3 shows the arm protector pad around a patient and in place on a patient's right and left arm.

FIG. 3 shows the arm protector pad (10) in use with a supine patient (400) shown in dotted lines resting on an operating room table (50) and operating room table mattress (55). In FIG. 3, the upper left arm protector section (20), the upper right arm protector section (21), the lower left arm protector section (30), and the lower right arm protector section (31) are rolled over and in place around a patient's (400) left and right arm. On the right side of the patient (400), the attachment tape (61) and (71) are shown. The right portion (65) of the central upper attachment tape (63) is seen underneath the patient (400), who is not shown in this portion of FIG. 3, for better view of the arm protector pad (10). It will be appreciated that a section of the right portion (65) will mate and attach to the attachment tape (61) which is not visualized in the drawing. The left portion (64) of the central upper attachment tape (63) is seen mating to the attachment tape (60) on the left arm upper protector section (20). The right arm lower protector section (31) attachment tape (71) is attached to the right portion (75) (not shown) of the central lower attachment tape (73). The point of attachment of the right portion (75) to the attachment tape (71) is not shown on the drawing but would be appreciated it would be hidden underneath the patient (400) and covered by the right arm lower protector section (31). The left portion (74) of the central lower attachment tape (73) is seen mating to the attachment tape (70) on the left arm lower protector section (30). Again shown here for clarity, the approximate central portion of the patient's left and right arms in the vicinity of the elbow joints is shown uncovered by the arm protector pad (10). It will also be readily appreciated that the various sections of the arm protector pad (10) may be disconnected from their attachment means and unrolled to completely uncover that portion of the patient's arm as is necessary. The entire patient can be moved from side to side or up and down on the bed and the arm protector pad (10) will slide with the patient on the operating room table mattress (55) if in the event of an emergency it was necessary to quickly reposition the patient or even move the patient to a different operating room table or to a stretcher. It will be appreciated that the arm protector pad (10) of the current invention will find its greatest use in operative procedures in a hospital. Currently, operating room tables are a standardized width (20 inches) and length (76 inches). Extenders can be applied to the operating room table. However, many larger people, especially obese people, will not be so easily positioned within the boundaries of the operating room table's (50) dimensions as the patient (400) is shown in FIG. 3. Indeed, for large patients, their arms will extend completely over the sides of the operating room table (50) and, without some kind of restraint, would be forced by gravity to hang downwardly, stressing the muscles and nerves of the arms. The arm protector pad (10) not only serves to protect the arm against outside pressure from operating room personnel but also serves to secure the arms in place in a safe and protected position. Circumstances other than an operating room could call for use of the arm protector pad (10). For example, someone may be transported in an ambulance from one hospital to another or from the scene of an accident or injury to a hospital. While ordinarily this is a brief transit time, it can be prolonged. If the patient needs to be secured on a stretcher during this period of time, belts to secure the patient in place can cause significant pressure to be exerted against a patient's arm. For a very young or very old patient even this transitory pressure can cause problems, including the beginnings of development of a decubitus ulcer. Consequently, in these circumstances the arm protector pad (10) could be used to secure the patient's arm against the patient's sides to avoid injuries to the patient's arms because of malpositioning of the arm during the transient time and to provide cushioning and protection for the patient's arms against pressure caused by straps or others devices, which may be around the patient to secure them in place on the stretcher or other device on which the patient is positioned during transit. It could also be used in rest home settings, rehabilitation hospitals, and other places where it may be necessary to secure patient's arms in a safe position for long periods of time.

Figure 4:
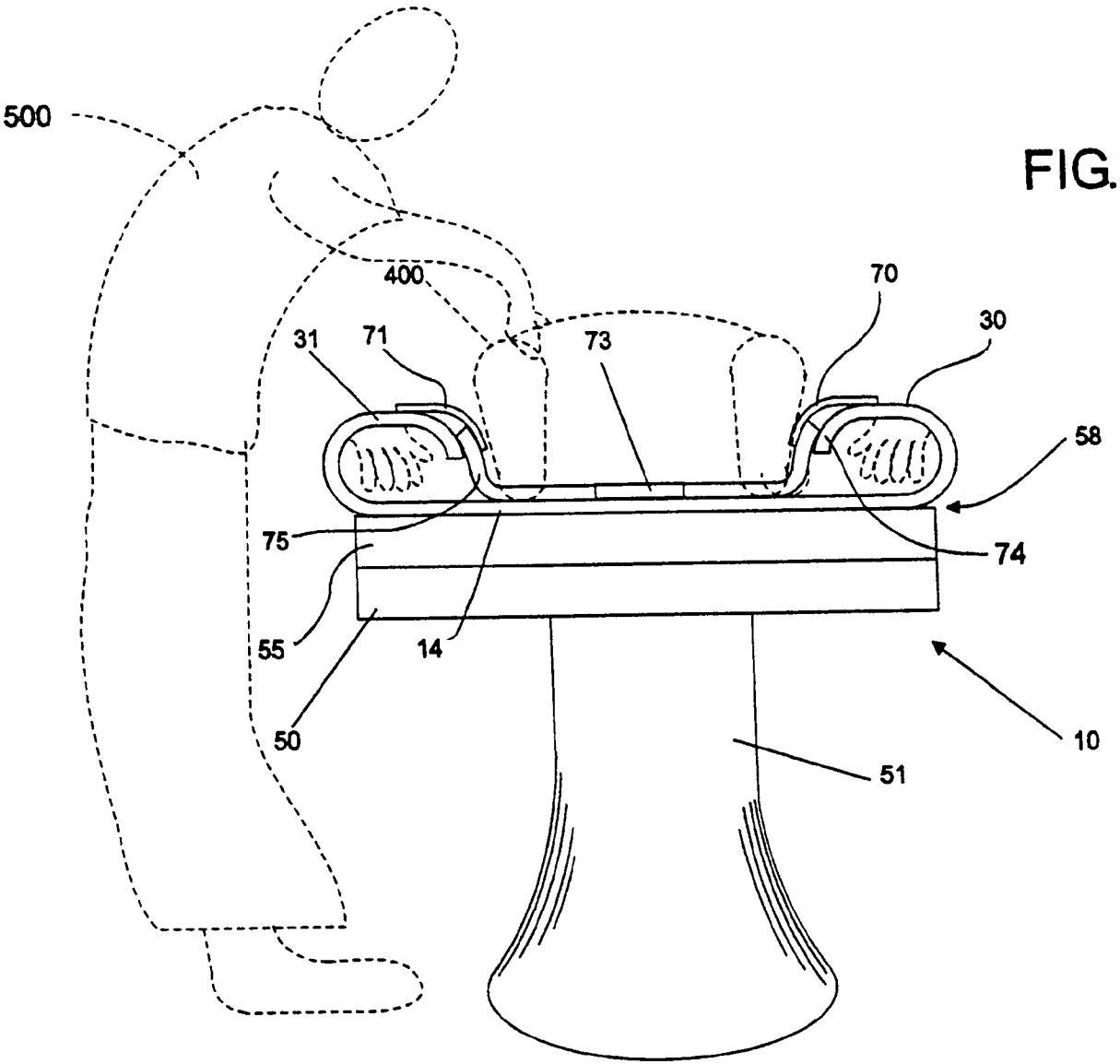
FIG. 4 shows the arm protector pad from the foot end of the patient.

FIG. 4 is a view from the foot (58) end of the operating room table (50). In this view, it can be appreciated that the protector pad invention (10) is between the operating room table mattress (55) and the patient (400), who is shown in dotted lines. The lower arm protector pad (14) is visualized on what would be the patient's (400) right side with the right arm lower protector section (31) wrapping and folding over the patient's right forearm. The right arm lower protector section (31) is shown wrapped around a patient's arm, although for clarity, with an exaggerated space between the right arm lower protector section (31) and the patient's arm. It will be appreciated that this is done to make the view more clear but, in practice, the right arm lower protector section (31) would be snugly wrapped around the patient's arm. The attachment tape (71) on the lower right arm protector section (31) is mated to the right portion (75) of the central lower attachment tape (73). Seen in dotted lines, is an operating room person (500) leaning across and over the patient (400), who is in the supine position on the operating room table (50). The use of the arm protector pad (10) secures the patient's (400) arm in place, provides an insulating and protective foam barrier between pressure from the operating room personnel (500) and the patient's (400) arm. It can be readily appreciated that once the patient (400) is position on the arm protector pad (10), it would be a simple matter to reach under the patient (400) for the right portion (75) of the central lower attachment tape (73) and connect it to the attachment tape (71) associated with the lower right arm protector section (31). Thus, an attachment is quickly and easily made and just as quickly and easily disconnected if need be. Because the arm protector pad (10) is made of a soft, bendable, foam material portions may be cut away or torn away as required in the event it is necessary to move the patient. The entire aim protector pad (10) could be moved with the patient or could be quickly and easily removed to roll the patient into a different position. The arm protector pad (10) and its respective left arm upper protection section (20), right arm upper protector section (21), right arm lower protector section (31), and left arm lower protector section (30) are radiolucent and x-rays can be taken through this material without worrying about detaching and reattaching it. It will also be readily appreciated by one of skill in the art, instead of pressure coming from an operating room personnel (500), the patient (400) could be positioned on a stretcher (not shown) with straps (not shown) holding the patient (400) in place on the stretcher (not shown). The straps (not shown) could cause pressure, especially on an elderly person, but the arm protector pad (10) would provide extra cushioning for the arms of the patient (400) while also securing the arm in a safe position against the patient's (400) side and avoiding stretching injuries to the patient's (400) arm.

It will be readily appreciated by one of skill in the art that variations in the materials used in construction of the arm protector pad (10), and its shape and dimensions can be readily varied without departing from the essential spirit of the invention. The foregoing description is by way of illustration and not by way of limitation. The only limitations are contained in the claims which follow.

I claim:

1. A method for protecting a patient's arms from stretch or pressure injuries during an operation who is in a supine or prone position on a patient support comprising:

(a) on a patient support surface, providing a one-piece foam pad with a central portion;

(b) positioning a patient in a prone or supine position on a patient support surface on top of said one-piece foam pad positioned thereon;

(c) providing on said one-piece foam pad a right arm section positionable around an upper right arm of a patient;

(d) providing means for attaching said right arm upper section to said central portion of said one-piece foam pad;

(e) folding said right arm upper section around a patient's upper right arm and attaching said right arm upper section to said central portion;

(f) providing on said one-piece foam pad a left arm upper section;

(g) providing means for attaching said left arm upper section to said central portion of said one-piece foam pad;

(h) folding said left arm upper section around a patient's upper left arm and attaching said left arm upper section to said central portion;

(i) providing on said-one piece foam pad a right lower arm section;

(j) providing means for attaching said right arm lower section to said central portion of said one-piece foam pad;

(k) folding said right arm lower section around a patient's lower right arm and attaching said right arm upper section to said central portion;

(l) providing on said one-piece foam pad a left arm lower section;

(m) providing means for attaching said left arm lower section to said central portion of said one-piece foam pad;

(n) folding said left arm lower section around a patient's lower left arm and attaching said left arm lower section to said central portion whereby patient's arms are positioned using said left and right upper section and said left and right lower sections in proximity to a patient's body avoiding stretch injuries to the patient's arms which could happen if patient's arms are forced by gravity into a position away from the body and providing foam padding around the patient's arms to protect the patient's arms from pressure injuries from operating room personnel who are standing in proximity to and placing pressure upon a patient's arms.

2. A method of claim 1 for at least one of said right arm upper section, left arm upper section, right arm lower section, and left arm lower section providing a perforated tear-a-way portion.

3. A method of claim 2 further comprising providing a perforated tear-a-way portion on each of said right arm upper section, said right arm lower section, said left arm upper section, and said left arm lower section.

4. A method claim of claim 3 further comprising providing said one-piece foam pad is radiolucent.

* * * * *